US008023850B2

(12) United States Patent
Okamoto et al.

(10) Patent No.: US 8,023,850 B2
(45) Date of Patent: Sep. 20, 2011

(54) IMAGE FORMING APPARATUS CAPABLE OF STABLY APPLYING OIL FOR FIXING

(75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Yoshihiro Sonohara, Hitachi (JP); Syoichi Kaneko, Ishioka (JP); Keisuke Kubota, Hitachinaka (JP); Takashi Kagami, Mito (JP); Hiroyuki Shimada, Zama (JP)

(73) Assignee: Ricoh Company, Limited, Tokyo (JP)

( * ) Notice: Subject to any disclaimer, the term of this patent is extended or adjusted under 35 U.S.C. 154(b) by 193 days.

(21) Appl. No.: 12/434,195

(22) Filed: May 1, 2009

(65) Prior Publication Data

US 2009/0274494 A1 Nov. 5, 2009

(30) Foreign Application Priority Data

May 2, 2008 (JP) ..... 2008-120448

(51) Int. Cl.
*G03G 15/20* (2006.01)

(52) U.S. Cl. ..... 399/67; 399/122; 399/324; 399/325; 399/328

(58) Field of Classification Search ..... 399/67, 399/122, 324, 325, 328
See application file for complete search history.

(56) References Cited

U.S. PATENT DOCUMENTS

| | | | | |
|---|---|---|---|---|
| 5,678,149 | A * | 10/1997 | Takekoshi et al. | 399/299 |
| 5,678,153 | A | 10/1997 | Okamoto et al. | |
| 7,164,878 | B2 * | 1/2007 | Yamanaka | 399/320 |
| 7,509,085 | B2 | 3/2009 | Yoshinaga et al. | |
| 2002/0044805 | A1 * | 4/2002 | Hasegawa | 399/325 |
| 2007/0237554 | A1 | 10/2007 | Mitsuya et al. | |
| 2008/0013995 | A1 | 1/2008 | Kubota et al. | |
| 2008/0170896 | A1 | 7/2008 | Kubota et al. | |
| 2009/0274477 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |

FOREIGN PATENT DOCUMENTS

JP 4115733 4/2008

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

An image forming apparatus includes an oil input device and a fixing device including a fixing member, a pressing member, and an oil applier. In the oil applier, an oil application member applies oil supplied from an oil supply mechanism to one of the fixing member and the pressing member. In the oil supply mechanism, an oil supply member provided adjacent to an oil storage member supplies oil sent from the oil storage member to the oil application member. When the fixing device is reattached to the image forming apparatus after the fixing device is detached from the image forming apparatus, oil sent from the oil input device through an oil inlet overflows the oil storage member, and is supplied to one of the oil supply member and the oil application member provided adjacent to the oil storage member before an image forming operation starts.

9 Claims, 12 Drawing Sheets

IMAGE FORMING APPARATUS CAPABLE OF STABLY APPLYING OIL FOR FIXING

CROSS-REFERENCE TO RELATED APPLICATION

The present application is based on and claims priority to Japanese Patent Application No. 2008-120448, filed on May 2, 2008 in the Japan Patent Office, the entire contents of which are hereby incorporated herein by reference.

BACKGROUND OF THE INVENTION

1. Field of the Invention

Exemplary aspects of the present invention relate to an image forming apparatus, and more particularly, to an image forming apparatus including a fixing device for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In such image forming apparatuses, oil is applied to a fixing member of the fixing device, which contacts the toner image on the sheet, to separate toner particles forming the toner image from the fixing member and to maintain fixing property, or the ability of the fixing member to fix the toner image on the sheet. The way in which the oil is applied requires a detailed discussion of the structure of a typical conventional fixing device.

In order to shorten a warm-up time period of the fixing device, an endless fixing belt is often used as the fixing member. FIG. 1 is a sectional view of a fixing device 100RA including just such an endless fixing belt.

As can be seen in FIG. 1, the fixing device 100RA loops an endless fixing belt 92 around a fixing roller 84 and a heating roller 83 in such a manner that the fixing roller 84 and the heating roller 83 apply a predetermined tension to the fixing belt 92. A pressing roller 85 rotates and presses against the fixing belt 92 and the fixing roller 84 to form a fixing nip portion AR between the fixing belt 92 and the pressing roller 85. A heater 86 is disposed inside the heating roller 83, and heats the fixing belt 92 via the heating roller 83. Similarly, a second, separate heater 87 is disposed inside the pressing roller 85, and heats the pressing roller 85. The fixing belt 92 and the pressing roller 85 apply heat and pressure to a sheet bearing a toner image at the fixing nip portion AR to fix the toner image on the sheet.

An oil application roller R1 serves as an oil applier for applying oil to the fixing belt 92. For example, the rotating oil application roller R1 applies oil supplied from an oil supplier to the fixing belt 92 at a contact point 95 at which the oil application roller R1 contacts the fixing belt 92. The rotating fixing belt 92 moves an oiled portion of the fixing belt 92 to which oil is applied to the fixing nip portion AR to separate the sheet bearing the toner image from the fixing belt 92. At the fixing nip portion AR, a part of the oil on the fixing belt 92 moves from the fixing belt 92 onto a surface of the pressing roller 85 to separate the sheet bearing the toner image from the pressing roller 85. Surplus oil carried on the pressing roller 85 then flows into an oil pan 96 provided under the pressing roller 85, and is collected by the oil pan 96.

However, in high-speed image forming apparatuses in which a sheet is conveyed at high speed, the oil application roller R1 may not be able to apply enough oil to the fixing belt 92, and consequently, a sheet bearing a toner image may not separate cleanly from the fixing belt 92.

BRIEF SUMMARY OF THE INVENTION

This specification describes below an image forming apparatus according to an exemplary embodiment of the present invention. In one exemplary embodiment of the present invention, the image forming apparatus includes an oil input device and a fixing device. The oil input device contains oil. The fixing device receives oil sent from the oil input device, and includes a rotatable fixing member, a pressing member, and an oil applier. The pressing member contacts the fixing member. The oil applier includes an oil application member and an oil supply mechanism. The oil application member applies oil to one of the fixing member and the pressing member across a predetermined width of the fixing member and the pressing member. The oil supply mechanism supplies oil to the oil application member, and includes an oil storage member, an oil inlet, and an oil supply member. The oil storage member is provided above and adjacent to one of the oil supply member and the oil application member, and stores oil. The oil inlet puts oil sent from the oil input device into the oil storage member. The oil supply member is provided adjacent to the oil storage member to supply oil sent from the oil storage member to the oil application member. When the fixing device is reattached to the image forming apparatus after the fixing device is detached from the image forming apparatus, oil sent from the oil input device overflows the oil storage member, and is supplied to one of the oil supply member and the oil application member provided adjacent to the oil storage member before an image forming operation starts.

This specification further describes below an image forming apparatus according to an exemplary embodiment of the present invention. In one exemplary embodiment of the present invention, the image forming apparatus includes an oil input device and a fixing device. The oil input device contains oil. The fixing device receives oil sent from the oil input device, and includes a rotatable fixing member, a pressing member, and an oil applier. The pressing member contacts the fixing member. The oil applier includes oiling means and an oil supply mechanism. The oiling means applies oil to one of the fixing member and the pressing member across a predetermined width of the fixing member and the pressing member. The oil supply mechanism supplies oil to the oiling means. The oil supply mechanism includes an oil storage member and an oil inlet. The oil storage member is provided above and adjacent to the oiling means to store oil. The oil inlet puts oil sent from the oil input device into the oil storage member. When the fixing device is reattached to the image forming apparatus after the fixing device is detached from the image forming apparatus, oil sent from the oil input device overflows the oil storage member, and is supplied to the oiling means provided adjacent to the oil storage member before an image forming operation starts.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
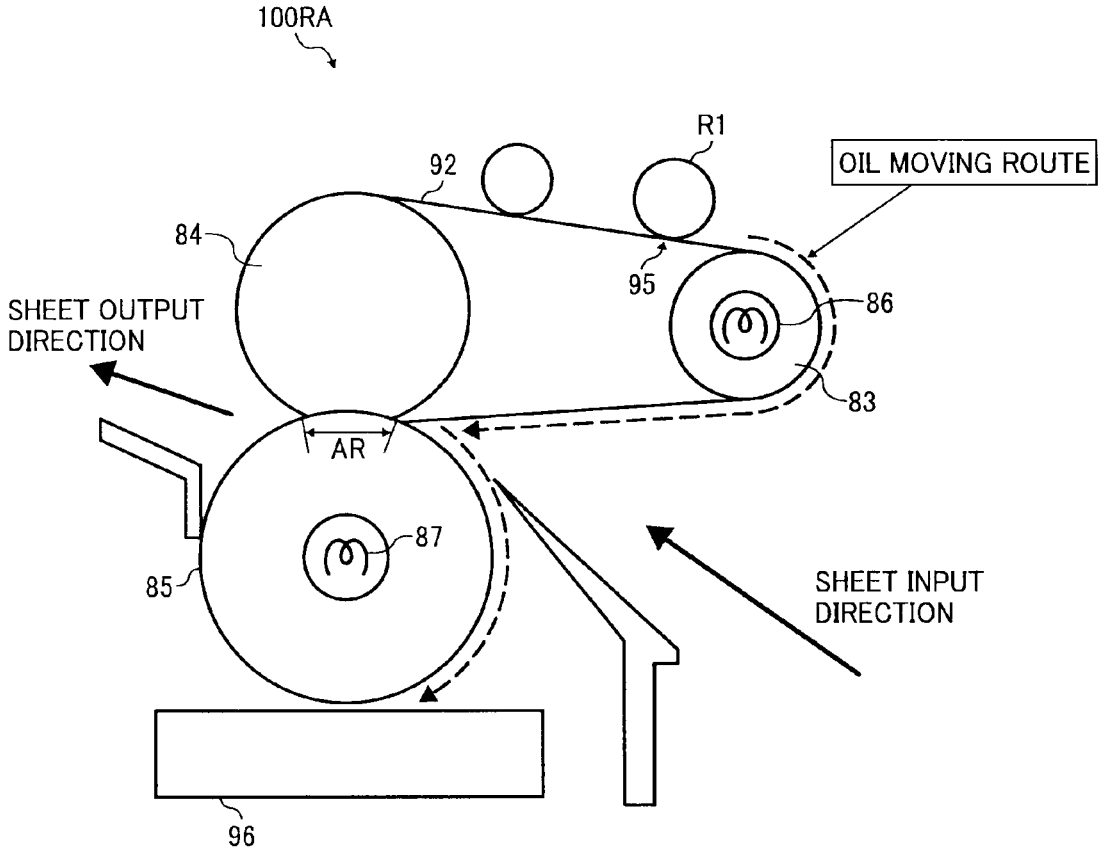
FIG. 1 RELATED ART
FIG. 1 is a sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
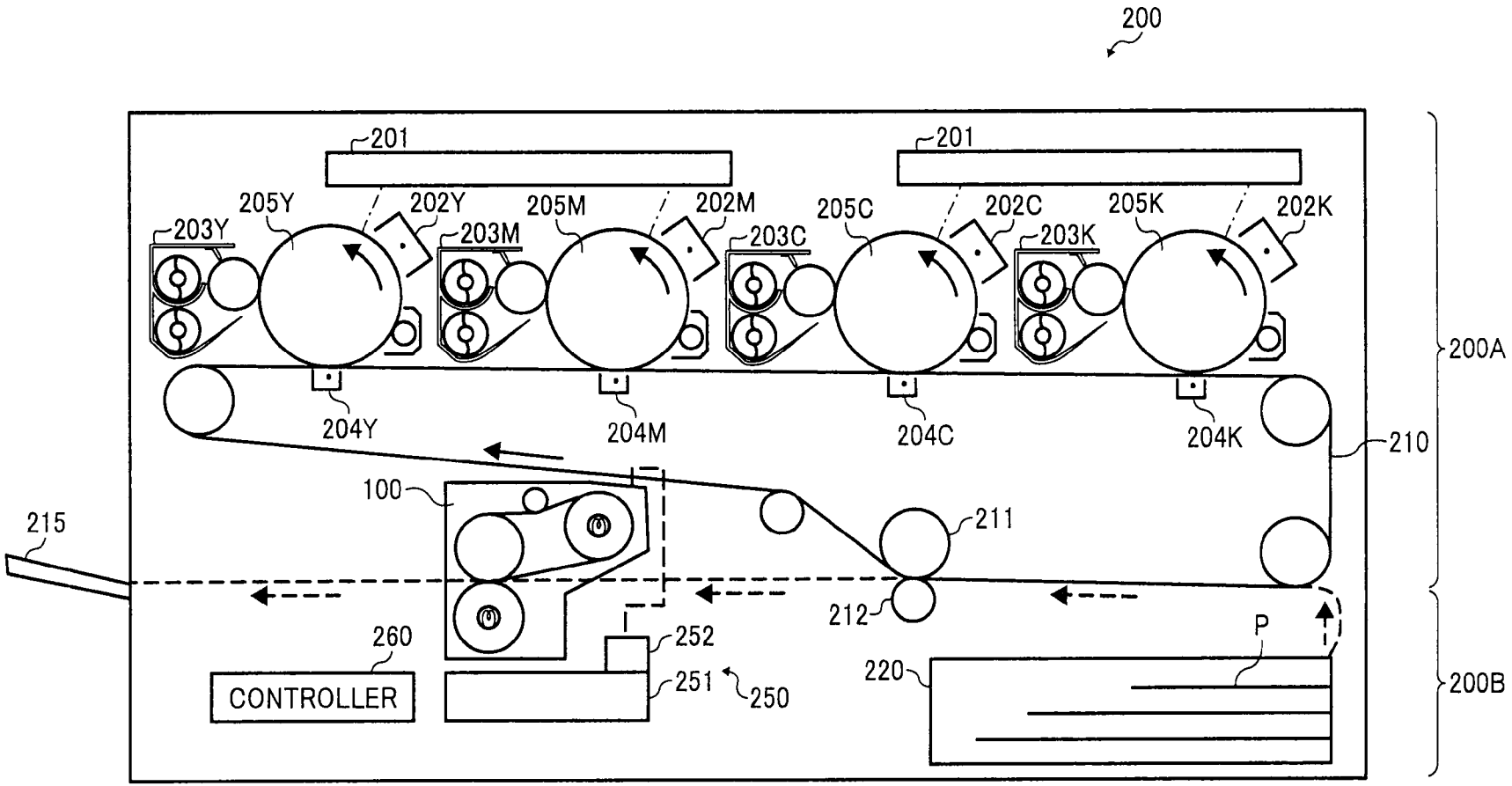
FIG. 2 is a sectional view of an image forming apparatus according to an exemplary embodiment of the present invention.

Referring now to the drawings, wherein like reference numerals designate identical or corresponding parts throughout the several views, in particular to FIG. 2, an image forming apparatus 200 according to an exemplary embodiment of the present invention is explained.

As illustrated in FIG. 2, the image forming apparatus 200 includes an image forming device 200A, a sheet supplier 200B, a stacker 215, and a controller 260.

The image forming device 200A includes optical writers 201, chargers 202Y, 202M, 202C, and 202K, development devices 203Y, 203M, 203C, and 203K, first transfer devices 204Y, 204M, 204C, and 204K, photoconductors 205Y, 205M, 205C, and 205K, a transfer belt 210, a roller 211, a transfer roller 212, a fixing device 100, and an oil circulation mechanism 250. The sheet supplier 200B includes a paper tray 220. The oil circulation mechanism 250 includes an oil tank 251 and an oil pump 252.

The image forming apparatus 200 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 200 functions as a tandem type color copier for forming a color image on a recording medium at high speed by electrophotography.

The image forming device 200A is provided at a center portion of the image forming apparatus 200. The sheet supplier 200B is provided under the image forming device 200A. An image reader is provided above the image forming device 200A.

In the image forming device 200A, the transfer belt 210 includes a transfer surface-extending in a horizontal direction. A mechanism for forming an image in a complementary color being complementary to a separation color is provided above the transfer belt 210. For example, the photoconductors 205Y, 205M, 205C, and 205K, serving as image carriers for carrying toner images in complementary colors (e.g., yellow, magenta, cyan, and black), are arranged along the transfer surface of the transfer belt 210.

The photoconductors 205Y, 205M, 205C, and 205K are formed of drums which rotate in an identical direction (e.g., counterclockwise in FIG. 2), respectively. The optical writers 201, the chargers 202Y, 202M, 202C, and 202K, the development devices 203Y, 203M, 203C, and 203K, the first transfer devices 204Y, 204M, 204C, and 204K, and cleaners surround the photoconductors 205Y, 205M, 205C, and 205K, respectively, to perform image forming processes while the photoconductors 205Y, 205M, 205C, and 205K rotate. The development devices 203Y, 203M, 203C, and 203K contain yellow, magenta, cyan, and black toners, respectively.

The transfer belt 210 is looped over a driving roller and a driven roller, and opposes the photoconductors 205Y, 205M, 205C, and 205K to move in a direction corresponding to the direction of rotation of the photoconductors 205Y, 205M, 205C, and 205K. The transfer roller 212 opposes the roller 211 serving as a driven roller.

In the sheet supplier 200B, the paper tray 220 loads sheets P serving as a recording medium. A conveyance mechanism feeds the sheets P loaded on the paper tray 220 one by one toward the transfer roller 212. For example, the conveyance mechanism separates an uppermost sheet P from other sheets P loaded on the paper tray 220, and conveys the sheet P toward the transfer roller 212. A conveyance path provided between the transfer roller 212 and the fixing device 100 conveys the sheet P in a horizontal direction. The controller 260 controls operations of the image forming apparatus 200.

The following describes image forming operations performed by the image forming apparatus 200. The charger 202Y uniformly charges a surface of the photoconductor 205Y. The optical writer 201 forms an electrostatic latent image on the charged surface of the photoconductor 205Y according to image data sent by the image reader. The development device 203Y for containing the yellow toner makes the electrostatic latent image formed on the photoconductor 205Y visible as a yellow toner image. The first transfer device 204Y applies a predetermined bias to the yellow toner image formed on the photoconductor 205Y to transfer the yellow toner image onto the transfer belt 210. Similarly, magenta, cyan, and black toner images are formed on the photoconductors 205M, 205C, and 205K, respectively, and sequentially transferred onto the transfer belt 210 by an electrostatic force so that the yellow, magenta, cyan, and black toner images are superimposed on the transfer belt 210 to form a color toner image on the transfer belt 210.

The transfer roller 212 transfers the color toner image from the transfer belt 210 onto the sheet P conveyed by the roller 211 and the transfer roller 212. The sheet P bearing the color toner image is further conveyed to the fixing device 100. The fixing device 100 fixes the color toner image on the sheet P. The sheet P bearing the fixed color toner image is sent to the stacker 215 via an output path.

The oil tank 251 collects oil used in the fixing device 100 to improve property for separating the sheet P from the fixing device 100. The oil pump 252 resupplies oil contained in the oil tank 251 to the fixing device 100. The oil tank 251 and the oil pump 252 serve as the oil circulation mechanism 250 provided for the fixing device 100.

Figure 3:
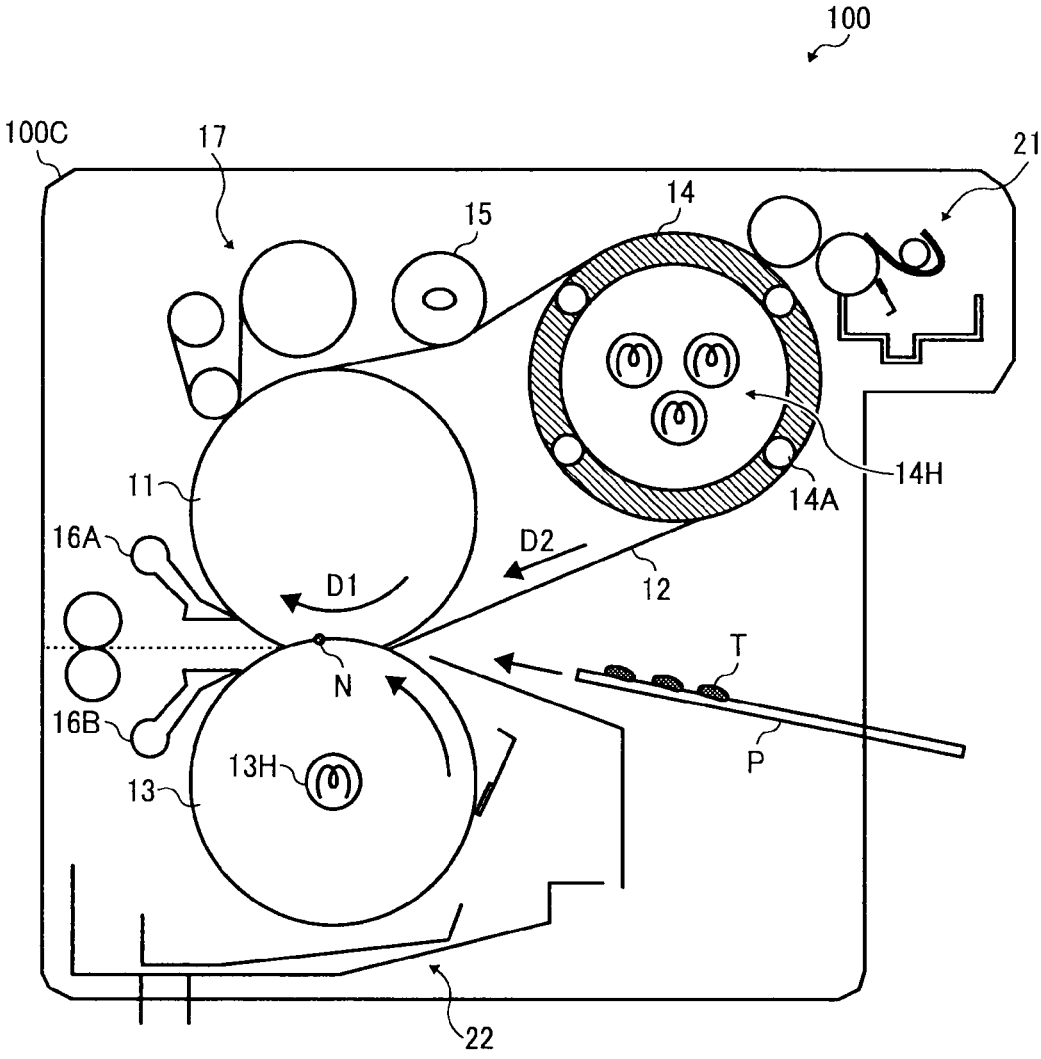
FIG. 3 is a sectional view of a fixing device included in the image forming apparatus shown in FIG. 2.

FIG. 3 is a sectional view of the fixing device 100. The fixing device 100 includes a fixing cover 100C, a fixing roller 11, a fixing belt 12, a pressing roller 13, a heater 13H, a heating roller 14, a heat pipe 14A, a heater 14H, a tension roller 15, separation nails 16A and 16B, a cleaning mechanism 17, and oil appliers 21 and 22.

The fixing roller 11, the fixing belt 12, the pressing roller 13, the heating roller 14, the separation nails 16A and 16B, and the cleaning mechanism 17 are provided inside the fixing cover 100C. The fixing belt 12, serving as a fixing member, is looped or stretched over the fixing roller 11 and the heating roller 14 with a predetermined tension. The pressing roller 13, serving as a pressing member, rotatably presses against the fixing belt 12 to form a fixing nip portion N between the fixing belt 12 and the pressing roller 13. The fixing belt 12 and the pressing roller 13 apply heat and pressure to a sheet P bearing a toner image T at the fixing nip portion N to fix the toner image T on the sheet P. The separation nail 16A is provided at an exit side of the fixing nip portion N in such a manner that a head of the separation nail 16A contacts or is disposed close to the fixing belt 12, so as to prevent a sheet P from wrapping around the fixing belt 12. The separation nail 16B is provided at the exit side of the fixing nip portion N in such a manner that a head of the separation nail 16B contacts the pressing roller 13, so as to prevent a sheet P from wrapping around the pressing roller 13. The cleaning mechanism 17 cleans the fixing belt 12 by pressing a cleaning web against the fixing belt 12.

The fixing belt 12 has an endless belt shape and has a double-layer structure in which an elastic layer, such as a silicon rubber layer, is formed on a base including nickel, stainless steel, and/or polyimide. The fixing roller 11 includes metal serving as a core metal and silicon rubber. In order to shorten a warm-up time period of the fixing device 100, the fixing roller 11 may include foamed silicon rubber so that the fixing roller 11 does not absorb heat from the fixing belt 12 easily. The heating roller 14 is formed of a hollow roller including aluminum or iron. The heater 14H, such as a halogen heater, serves as a heat source and is provided inside the heating roller 14. Alternatively, an induction heating (IH) mechanism may serve as the heat source. A plurality of heat pipes 14A, which is formed of hollow pipes, is provided in a thick wall of the heating roller 14. For example, the heat pipes 14A are embedded in the thick wall of the heating roller 14 in such a manner that the heat pipes 14A are evenly spaced in a circumferential direction of the heating roller 14 and that a longitudinal direction of the heat pipes 14A corresponds to a longitudinal direction (e.g., a width direction or an axial direction) of the heating roller 14. The heat pipes 14A improve heat transmission from the heater 14H to a surface of the heating roller 14, and thereby the heating roller 14 uniformly heats the fixing belt 12 quickly.

When the fixing device 100 is driven, in a state in which the tension roller 15 presses against the fixing belt 12 to apply proper tension to the fixing belt 12, the fixing roller 11 rotates clockwise in FIG. 3 in a direction of rotation D1 to rotate the fixing belt 12 clockwise in FIG. 3 in a direction of rotation D2 in which the fixing belt 12 feeds a sheet P out of the fixing nip portion N. Thus, the rotating fixing belt 12 rotates the pressing roller 13. Alternatively, instead of the fixing roller 11, the pressing roller 13 or the heating roller 14 may drive and rotate the fixing belt 12. In order to fix a toner image T on a sheet P, the heater 14H provided inside the heating roller 14 generates heat to heat the fixing belt 12 until a thermistor detects that the fixing belt 12 is heated up to a predetermined temperature (e.g., a proper fixing temperature). According to this exemplary embodiment, the fixing belt 12, that is, an endless belt, serves as a fixing member. Alternatively, a fixing roller, for example, a hollow cylindrical roller may serve as a fixing member.

The pressing roller 13 is formed of a cylindrical roller in which an elastic layer including silicon rubber is provided on a core metal including aluminum or iron. A pressure applier applies constant pressure to the pressing roller 13 to press the pressing roller 13 against the fixing belt 12. The heater 13H is provided inside the pressing roller 13, and generates heat to heat the pressing roller 13 up to a predetermined temperature as needed, for example, to fix a toner image T on a sheet P.

In the fixing device 100, a surface of the fixing belt 12 is heated up to a predetermined temperature in a state in which the fixing belt 12 and the pressing roller 13 are driven and rotated. When a sheet P bearing an unfixed toner image T passes through the fixing nip portion N, that is, when the sheet P moves leftward in FIG. 3, the fixing belt 12 and the pressing roller 13 apply heat and pressure at the fixing nip portion N to the sheet P to melt and fix the unfixed toner image T on the sheet P.

When the sheet P bearing the fixed toner image T is discharged from the fixing nip portion N, the sheet P may adhere to or wrap around the fixing belt 12 or the pressing roller 13. To address this, the oil appliers 21 and 22 apply oil to the fixing belt 12 and the pressing roller 13 to improve property for separating the sheet P from the fixing belt 12 and the pressing roller 13, respectively. The applied oil may be heat-resistant fixed oil, such as silicon oil. When the head of the separation nail 16A or 16B contacts a leading edge of the sheet P, the separation nail 16A or 16B separates the sheet P from the fixing belt 12 or the pressing roller 13, respectively. The sheet P discharged from the fixing nip portion N passes through a predetermined discharge path and is sent out of the fixing device 100.

The oil appliers 21 and 22 apply a proper amount of oil to the fixing belt 12 and the pressing roller 13, respectively. The separation nails 16A and 16B provided at the exit side of the fixing nip portion N operate as needed. Accordingly, the sheet P is discharged out of the fixing nip portion N to the exit side of the fixing nip portion N without adhering to or wrapping around the fixing belt 12 or the pressing roller 13.

Figure 4:
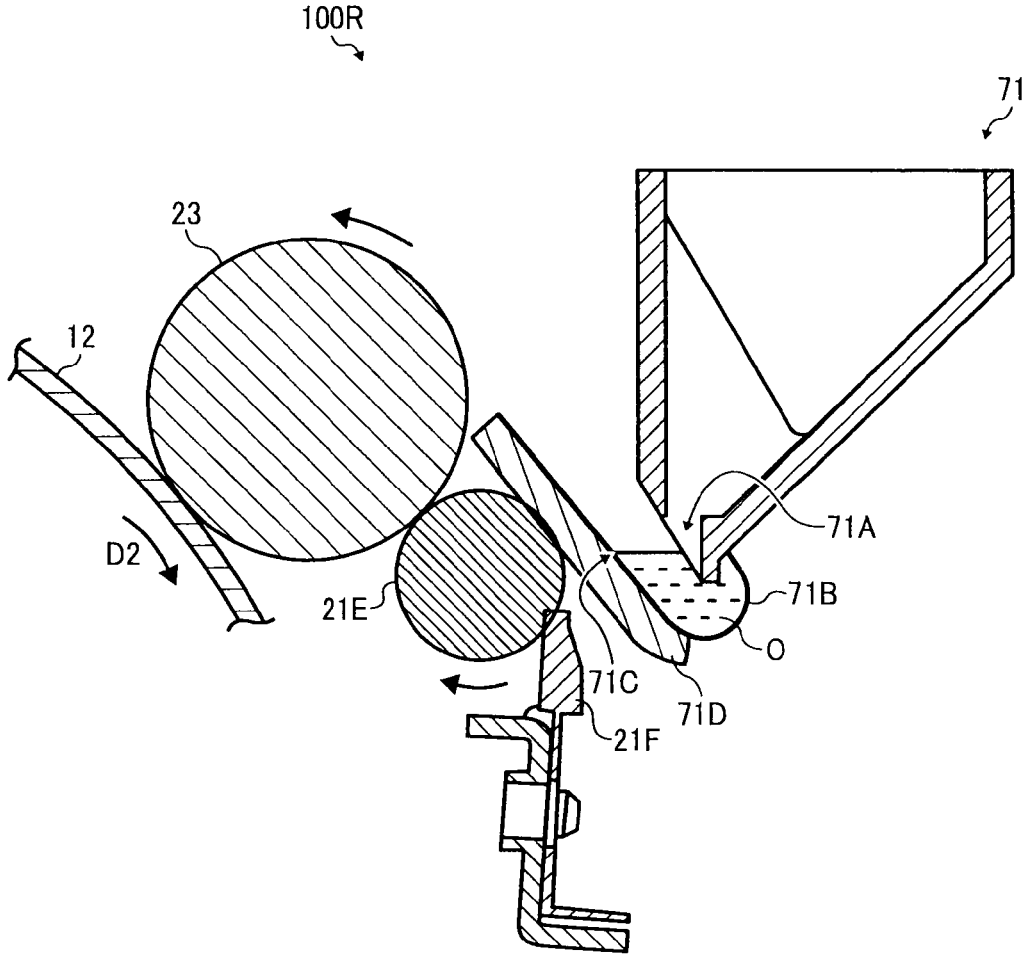
FIG. 4 is a sectional view of a reference oil applier.

Referring to FIG. 4, the following describes a fixing device 100R including a reference oil applier 71 for applying oil to the fixing belt 12. FIG. 4 is a sectional view of the oil applier 71.

The oil applier 71 includes an oil inlet 71A, an oil receiver 71B, a supply felt 71D, a supply roller 21E, a metering blade 21F, and an application roller 23. The oil receiver 71B includes a through-hole 71C.

Oil O is put into the oil receiver 71B from an outside of the fixing device 100R through the oil inlet 71A. The oil receiver 71B has a U-like shape in cross-section by sheet metal processing. For example, the oil receiver 71B has a gutter-like shape and the through-hole 71C is provided on a side of the oil receiver 71B. The oil receiver 71B is tilted so that the side of the oil receiver 71B on which the through-hole 71C is provided faces downward. The supply felt 71D, serving as a felt member, contacts the side of the oil receiver 71B to receive oil O from the through-hole 71C. The supply roller 21E receives oil O from the supply felt 71D. The metering blade 21F adjusts an amount of oil O adhered to the supply roller 21E, that is, an amount of oil O held by the supply roller 21E. The oil inlet 71A, the oil receiver 71B including the through-hole 71C, the supply felt 71D, the supply roller 21E, and the metering blade 21F serve as an oil supply mechanism for supplying oil O to the application roller 23. The application roller 23 serves as an oil application member for applying oil O supplied from the oil supply mechanism to the fixing belt 12.

In the oil supply mechanism, the oil receiver 71B stores oil O put through the oil inlet 71A. When an oil level is above the through-hole 71C, oil O is supplied from the oil receiver 71B to the supply felt 71D through the through-hole 71C. The supply felt 71D sends the oil O from a lower position contacting and corresponding to the through-hole 71C to an upper position contacting and corresponding to the supply roller 21E by capillary phenomenon. The oil O is adhered from the supply felt 71D to the supply roller 21E at a contact portion of the supply felt 71D contacting the supply roller 21E. A driving force applied from an outside of the supply roller 21E drives and rotates the supply roller 21E clockwise in FIG. 4. The rotating supply roller 21E moves an adhered portion of the supply roller 21E, to which the oil O supplied from the supply felt 71D is adhered, toward the application roller 23. However, before the adhered portion of the supply roller 21E contacts the application roller 23 to supply the oil O to the application roller 23, the metering blade 21F adjusts an amount of the oil O adhered to the supply roller 21E. After the oil O is supplied from the supply roller 21E to the application roller 23 at a position at which the supply roller 21E contacts the application roller 23, an oiled portion of the application roller 23 to which the oil O supplied from the supply roller 21E is adhered contacts the fixing belt 12 to apply the oil O to the fixing belt 12.

With the above-described structure, the oil applier 71 applies the oil O to the fixing belt 12. However, the oil O may contain fine solid impurities (e.g., dust and calcium carbonate originating from a recording medium). The impurities may accumulate in the supply felt 71D over time. The impurities accumulated in the supply felt 71D may prevent movement of the oil O by capillary phenomenon, and thereby a decreased amount of the oil O may be supplied to the supply roller 21E. Accordingly, a decreased amount of the oil O may be applied to the fixing belt 12, resulting in degraded property of the fixing belt 12 for separating a recording medium from the fixing belt 12. Further, when a recording medium is conveyed at high linear speed (e.g., 300 mm/s or higher) or when coated paper is used as a recording medium, a sufficient amount of the oil O needs to be applied to the fixing belt 12 stably. However, capillary phenomenon of the supply felt 71D may not supply the sufficient amount of the oil O to the fixing belt 12, resulting in degraded property of the fixing belt 12 for separating the recording medium from the fixing belt 12.

Figure 5:
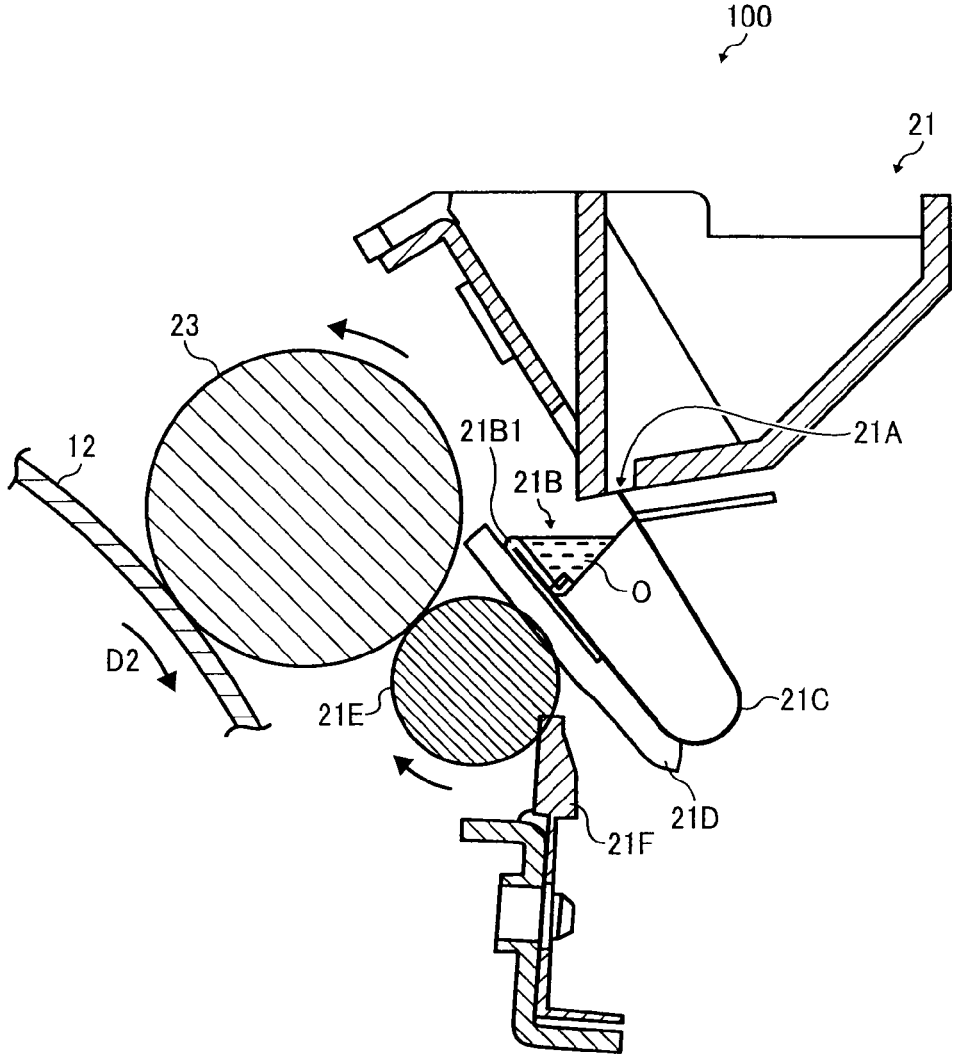
FIG. 5 is a partially sectional view of the fixing device shown in FIG. 3.

To address this, the fixing device 100 according to this exemplary embodiment includes an improved oil supply mechanism. FIG. 5 is a partially sectional view of the fixing device 100. The fixing device 100 includes the fixing belt 12 and the oil applier 21. The oil applier 21 includes the application roller 23, an oil inlet 21A, an oil storage 21B, a support plate 21C, a supply felt 21D, the supply roller 21E, and the metering blade 21F. The oil storage 21B includes a cut portion 21B1.

The fixing belt 12, serving as a fixing member, rotates in the direction of rotation D2. The pressing roller 13 (depicted in FIG. 3), serving as a pressing member, contacts the fixing belt 12 to form the fixing nip portion N (depicted in FIG. 3) between the fixing belt 12 and the pressing roller 13. The oil applier 21 (e.g., an oil supplier) includes an oil application member and an oil supply mechanism. The oil application member includes the application roller 23, and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, the support plate 21C, the supply felt 21D, the supply roller 21E, and the metering blade 21F.

In the oil supply mechanism, the oil storage 21B is an upwardly concave gutter, that is, a concave portion or a concave member having a gutter-like shape, and receives and stores oil O put through the oil inlet 21A. A longitudinal direction of the oil storage 21B is parallel to a width direction (e.g., an axial direction) of the application roller 23 serving as the oil application member. The oil storage 21B is provided above the adjacent supply felt 21D serving as an oil supply member. When oil O is put into the oil storage 21B through the oil inlet 21A, the oil O overflows the oil storage 21B at an upper portion or an upper edge (e.g., the cut portion 21B1) of the oil storage 21B, and flows into the adjacent supply felt 21D.

The above-described structure of the oil applier 21 for applying oil O to the fixing belt 12 is also applicable to the oil applier 22 (depicted in FIG. 3) for applying oil O to the pressing roller 13.

Figure 6:
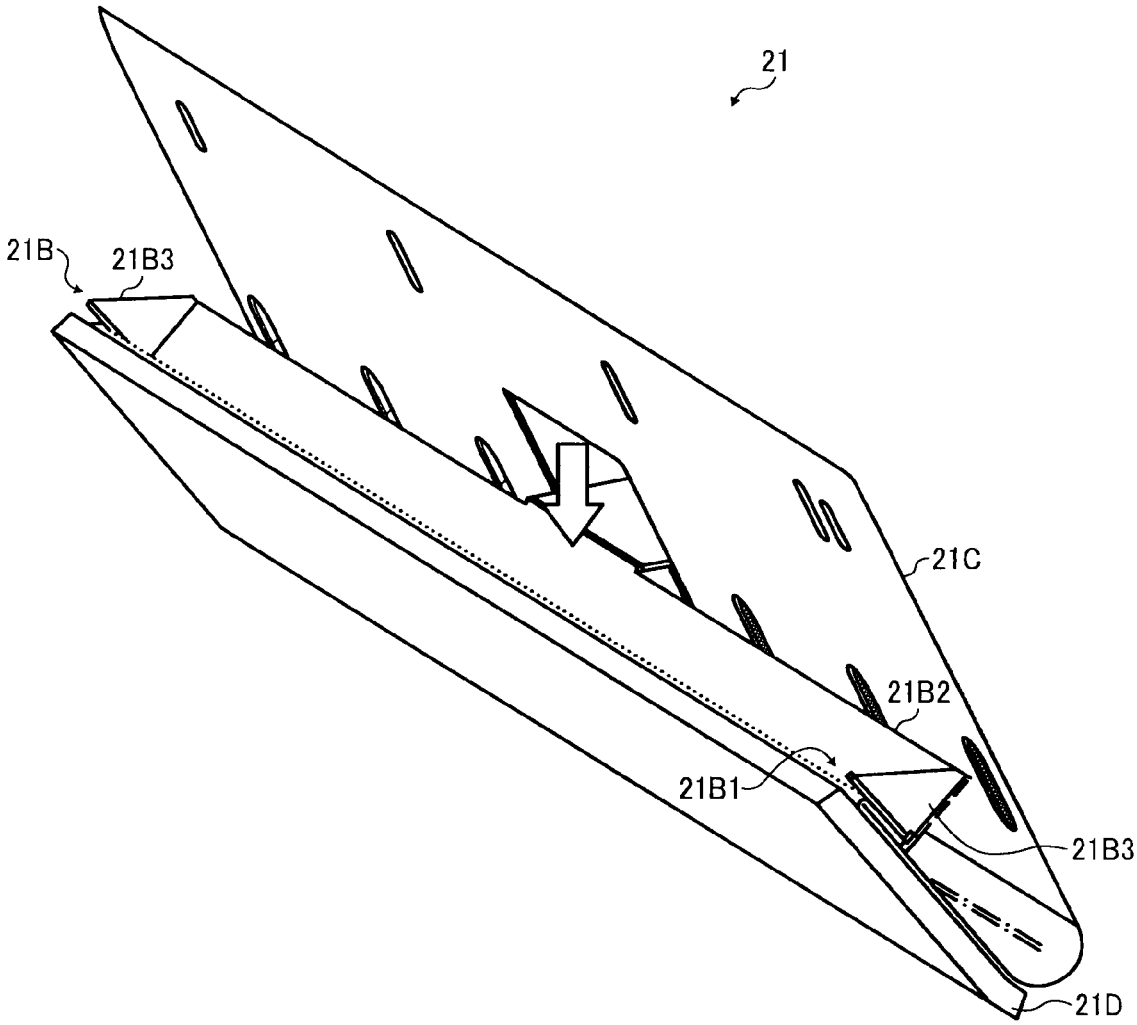
FIG. 6 is a partial perspective view of an oil applier included in the fixing device shown in FIG. 5.

FIG. 6 is a partial perspective view of the oil applier 21. Namely, FIG. 6 is a perspective view of a part of the oil supply mechanism of the oil applier 21, which are the oil storage 21B, the support plate 21C, and the supply felt 21D. The oil storage 21B further includes a gutter 21B2 and side plates 21B3.

The oil storage 21B is the upwardly concave gutter, that is, the concave portion or the concave member having the gutter-like shape, and includes the gutter 21B2 and the side plates 21B3. The gutter 21B2 has a V-like shape in cross-section. The side plates 21B3 are provided at both ends of the gutter 21B2 in a longitudinal direction of the gutter 21B2, and close a channel of the gutter 21B2. As illustrated in FIG. 5, the support plate 21C supports the oil storage 21B in such a manner that the oil storage 21B is disposed above the supply roller 21E and that the longitudinal direction of the gutter 21B2 (depicted in FIG. 6) is parallel to a width direction (e.g., an axial direction) of the supply roller 21E, the width direction (e.g., the axial direction) of the application roller 23, and a width direction (e.g., an axial direction) of the fixing belt 12. As illustrated in FIG. 6, the gutter 21B2 is formed of a loop-back portion of the support plate 21C provided at one end of the support plate 21C and a band plate of which end is fixed to the loop-back portion of the support plate 21C. The side plates 21B3 are fixed to both ends of the gutter 21B2 in the longitudinal direction of the gutter 21B2. Alternatively, the gutter 21B2 may be molded by sheet metal processing and the side plates 21B3 may be attached to the gutter 21B2. Yet alternatively, the gutter 21B2 may be molded with the side plates 21B3. Further, the oil storage 21B may include heat-resistant metal or plastic not reacting to oil O.

As illustrated in FIG. 5, an upper open end of the oil storage 21B facing the adjacent supply felt 21D serves as the cut portion 21B1 provided at a position lower than other ends of the oil storage 21B (e.g., another end of the gutter 21B2 and upper ends of the side plates 21B3 depicted in FIG. 6). When the fixing device 100 is driven, oil O is put into the oil storage 21B through the oil inlet 21A at a center of a width direction (e.g., a longitudinal direction) of the oil storage 21B until the oil O overflows the oil storage 21B. The oil O starts flowing out of the cut portion 21B1, and is supplied to the application roller 23 via the adjacent supply felt 21D and the supply roller 21E. Specifically, the oil O overflows the oil storage 21B in a full width of the cut portion 21B1, and thereby is supplied to the supply roller 21E and the application roller 23 in a predetermined width (e.g., a full width) of the supply roller 21E and the application roller 23 via the supply felt 21D. Thereafter, the oil O is applied to the fixing belt 12 in a predetermined width (e.g., a full width) of the fixing belt 12.

The support plate 21C is formed in a gutter-like shape having a U-like shape in cross-section, and supports the oil storage 21B and the supply felt 21D. When the support plate 21C is formed of a metal material by sheet metal processing to have proper spring property, the support plate 21C causes the supply felt 21D to contact the supply roller 21E while applying constant pressure to the support roller 21E.

The supply felt 21D is provided adjacent to the oil storage 21B, and supplies oil O from an upper portion or an upper edge (e.g., the cut portion 21B1) of the oil storage 21B to the supply roller 21E. For example, the supply felt 21D is provided between the oil storage 21B and the supply roller 21E, and contacts the oil storage 21B in a state in which a height of an upper end of the supply felt 21D is equal to a height of an upper end of the cut portion 21B1 of the oil storage 21B. Alternatively, the upper end of the supply felt 21D may protrude upward from the upper end of the cut portion 21B1 of the oil storage 21B. The supply felt 21D may be a compressed sheet including heat-resistant fiber not reacting to oil O, such as meta-aramid fiber. Oil O permeates the fiber of the supply felt 21D while the supply felt 21D holds the oil O inside. Therefore, the fiber of the supply felt 21D may have a mesh rougher than a mesh of a filter used for removing impurities. Thus, the supply felt 21D receives oil O flowing from the cut portion 21B1 and the oil O flows along the supply felt 21D. According to this exemplary embodiment, oil O falls down freely from the upper portion, that is, the cut portion 21B1 of the oil storage 21B to the supply roller 21E by gravity. The supply felt 21D supplies oil O to the supply roller 21E at a contact portion for contacting the supply roller 21E.

The oil supply mechanism further includes the supply roller 21E and the metering blade 21F. The supply roller 21E receives oil O from the supply felt 21D. The metering blade 21F adjusts an amount of oil O adhered to the supply roller 21E (e.g., an amount of oil O held by the supply roller 21E). A surface of the supply roller 21E includes a material corresponding to the oil O, such as silicon rubber. The metering blade 21F includes a material capable of regulating the amount of oil O adhering to the supply roller 21E without damaging the surface of the supply roller 21E, such as fluorocarbon rubber.

Figure 7:
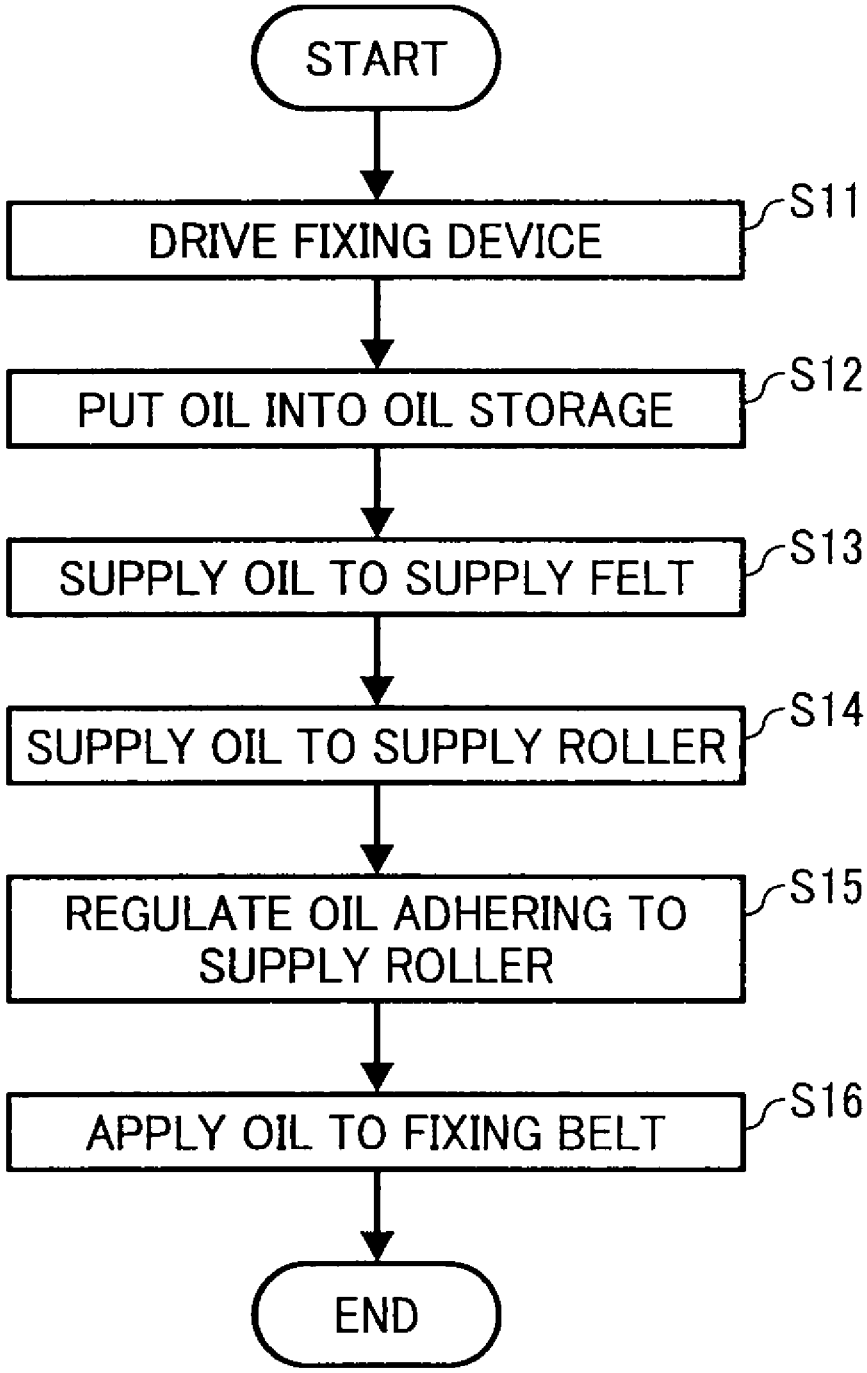
FIG. 7 is a flowchart illustrating a procedure for supplying oil from an oil supply mechanism to an oil application member in the oil applier shown in FIG. 6.

Referring to FIGS. 5 to 7, the following describes a procedure for supplying oil O from the oil supply mechanism to the oil application member with the above-described structure. FIG. 7 is a flowchart illustrating the procedure for supplying oil O from the oil supply mechanism to the oil application member.

In step S11, the fixing device 100 is driven. Accordingly, when the fixing belt 12 rotates, the supply roller 21E starts rotating. The application roller 23 contacting the fixing belt 12 and the supply roller 21E also starts rotating.

Simultaneously, in step S12, oil O is put into the oil storage 21B through the oil inlet 21A to store the oil O in the oil storage 21B.

In step S13, oil O continues being put into the oil storage 21B, and the oil O overflows the oil storage 21B. Specifically, the oil O overflows in the full width of the cut portion 21B1 of the oil storage 21B to supply the oil O to the supply felt 21D in a full width of the supply felt 21D.

In step S14, the oil O permeates the supply felt 21D from the upper portion to a lower portion of the supply felt 21D. The supply felt 21D supplies the oil O to the supply roller 21E in the predetermined width of the supply roller 21E at the contact portion for contacting the supply roller 21E.

In step S15, the rotating supply roller 21E moves an oiled portion of the supply roller 21E supplied with the oil O, and the metering blade 21F contacting the supply roller 21E regulates the amount of oil O adhering to the supply roller 21E.

In step S16, the supply roller 21E supplies the oil O to the application roller 23 in the predetermined width of the application roller 23 at a contact portion for contacting the application roller 23. Thereafter, the application roller 23 applies the oil O to the fixing belt 12 in the predetermined width of the fixing belt 12.

As described above, according to this exemplary embodiment, the processes for supplying oil O from the oil supply mechanism to the oil application member do not use capillary phenomenon of the supply felt 21D. For example, oil O flows down from the oil storage 21B to the supply roller 21E by gravity, resulting in stable supply of a sufficient amount of oil O.

Oil O used in the fixing device 100 has a certain level of viscosity. Therefore, even when oil O is put into the oil storage 21B through the oil inlet 21A, the oil O does not spread in the width direction of the oil storage 21B quickly. For example, oil O accumulates at a position on the oil storage 21B corresponding to the oil inlet 21A. Namely, a level of oil O may be highest at the position on the oil storage 21B corresponding to the oil inlet 21A and may become lower toward both ends in the width direction of the oil storage 21B. Accordingly, distribution of an amount of oil O overflowing the cut portion 21B1 of the oil storage 21B and flowing onto the supply roller 21E may be uneven in the width direction of the supply roller 21E.

To address this, a draw felt may be provided in a draw region on the oil storage 21B other than a region in which the oil inlet 21A is provided in the width direction of the oil storage 21B, so that the draw felt draws oil O from the gutter 21B2 of the oil storage 21B to the supply felt 21D. Thus, oil O is also supplied from the draw region of the oil storage 21B to the supply felt 21D easily. In this case, capillary phenomenon supplies oil O from the draw felt to the supply felt 21D. However, capillary phenomenon is used secondarily to adjust distribution of oil O in a width direction (e.g., a longitudinal direction) of the supply felt 21D. Moreover, a distance between the draw felt and the supply felt 21D is small. Thus, the draw felt can provide practical utility.

Alternatively, a plurality of oil inlets 21A may be provided in the width direction of the oil storage 21B, so that oil O put into the oil storage 21B through the plurality of oil inlets 21A has a uniform height in the width direction of the oil storage 21B.

Yet alternatively, a height of the upper end of the cut portion 21B1 of the oil storage 21B may be higher at a position corresponding to the oil inlet 21A than a height of the upper end of the cut portion 21B1 at other positions. Thus, an amount of oil O overflowing the cut portion 21B1 can be adjusted in the width direction of the oil storage 21B.

Figure 8:
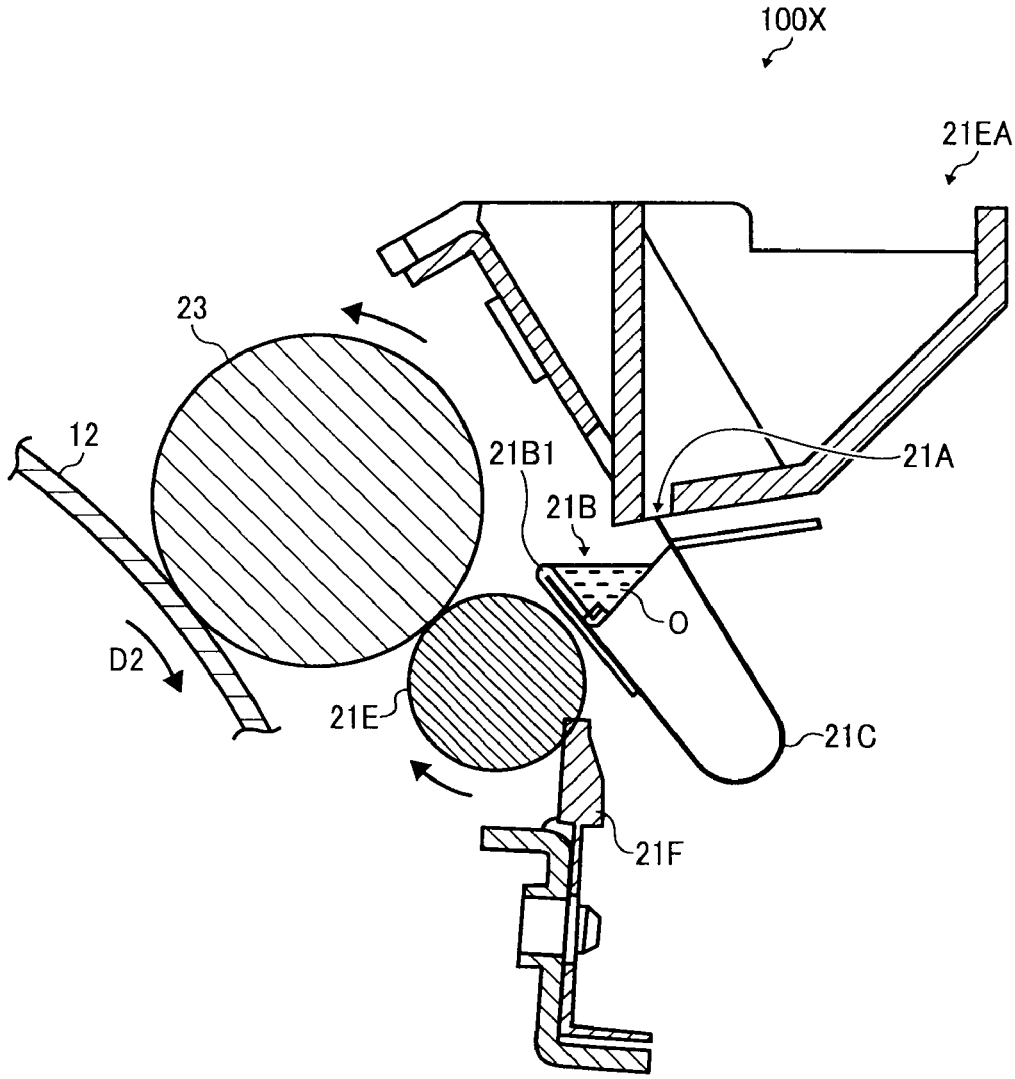
FIG. 8 is a partially sectional view of a fixing device according to another exemplary embodiment of the present invention.

Referring to FIG. 8, the following describes a fixing device 100X according to another exemplary embodiment. FIG. 8 is a partially sectional view of the fixing device 100X. The fixing device 100X includes an oil applier 21EA. In the fixing device 100X, the oil applier 21EA does not include the supply felt 21D depicted in FIG. 5. The other elements of the fixing device 100X are common to the fixing device 100 depicted in FIG. 5.

Since the oil applier 21EA does not include the supply felt 21D, the oil storage 21B is provided adjacent to the supply roller 21E.

The fixing belt 12, serving as a fixing member, rotates in the direction of rotation D2. The pressing roller 13 (depicted in FIG. 3), serving as a pressing member, contacts the fixing belt 12 to form the fixing nip portion N (depicted in FIG. 3) between the fixing belt 12 and the pressing roller 13. The oil applier 21EA (e.g., an oil supplier) includes an oil application member and an oil supply mechanism. The oil application member includes the application roller 23, and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, the support plate 21C, the supply roller 21E, and the metering blade 21F.

In the oil supply mechanism, the oil storage 21B is the upwardly concave gutter, that is, the concave portion or the concave member having the gutter-like shape, and receives and stores oil O put through the oil inlet 21A. The longitudinal direction of the oil storage 21B is parallel to the width direction (e.g., the axial direction) of the application roller 23. The oil storage 21B is provided above the adjacent supply roller 21E serving as an oil supply member. When oil O is put into the oil storage 21B through the oil inlet 21A, the oil O overflows the oil storage 21B at the upper portion or the upper edge (e.g., the cut portion 21B1) of the oil storage 21B, and flows onto the adjacent supply roller 21E.

The oil applier 21EA can provide effects similar to the effects provided by the oil applier 21 depicted in FIG. 5.

The above-described structure of the oil applier 21EA for applying oil O to the fixing belt 12 is also applicable to the oil applier 22 (depicted in FIG. 3) for applying oil O to the pressing roller 13.

Figure 9:
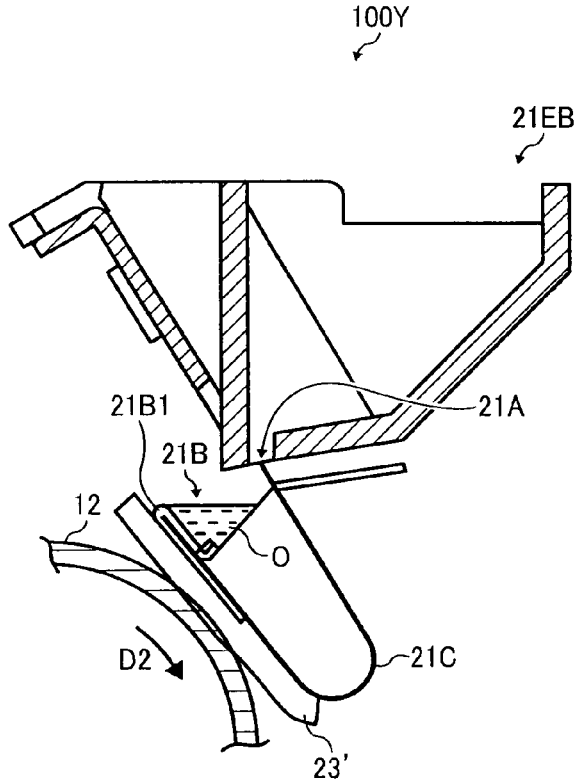
FIG. 9 is a partially sectional view of a fixing device according to yet another exemplary embodiment of the present invention.

Referring to FIG. 9, the following describes a fixing device 100Y according to yet another exemplary embodiment. FIG. 9 is a partially sectional view of the fixing device 100Y. The fixing device 100Y includes an oil applier 21EB. In the fixing device 100Y, the oil applier 21EB includes an application felt 23' instead of the application roller 23 depicted in FIG. 5, and does not include the supply felt 21D, the supply roller 21E, and the metering blade 21F depicted in FIG. 5. The other elements of the fixing device 100Y are common to the fixing device 100 depicted in FIG. 5.

The oil storage 21B is provided adjacent to the application felt 23'. The fixing belt 12, serving as a fixing member, rotates in the direction of rotation D2. The pressing roller 13 (depicted in FIG. 3), serving as a pressing member, contacts the fixing belt 12 to form the fixing nip portion N (depicted in FIG. 3) between the fixing belt 12 and the pressing roller 13. The oil applier 21EB (e.g., an oil supplier) includes an oil application member and an oil supply mechanism. The oil application member includes the application felt 23', and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, and the support plate 21C.

In the oil supply mechanism, the oil storage 21B is the upwardly concave gutter, that is, the concave portion or the concave member having the gutter-like shape, and receives and stores oil O put through the oil inlet 21A. The longitudinal direction of the oil storage 21B is parallel to a width direction (e.g., a longitudinal direction) of the application felt 23'. The oil storage 21B is provided above the adjacent application felt 23' serving as an oil supply member and an oil application member. When oil O is put into the oil storage 21B through the oil inlet 21A, the oil O overflows the oil storage 21B at the upper portion or the upper edge (e.g., the cut portion 21B1) of the oil storage 21B, and flows into the adjacent application felt 23'. The application felt 23' may be equivalent to the supply felt 21D depicted in FIG. 5.

The oil applier 21EB can provide effects similar to the effects provided by the oil applier 21 depicted in FIG. 5.

The above-described structure of the oil applier 21EB for applying oil O to the fixing belt 12 is also applicable to the oil applier 22 (depicted in FIG. 3) for applying oil O to the pressing roller 13.

In the fixing device 100 depicted in FIG. 3, the fixing device 100X depicted in FIG. 8, and the fixing device 100Y depicted in FIG. 9, the fixing belt 12, serving as a fixing member, is disposed above the pressing roller 13 serving as a pressing member. Alternatively, a fixing member having a roller shape may be provided above a pressing member having a belt shape, as illustrated in FIG. 10.

Figure 10:
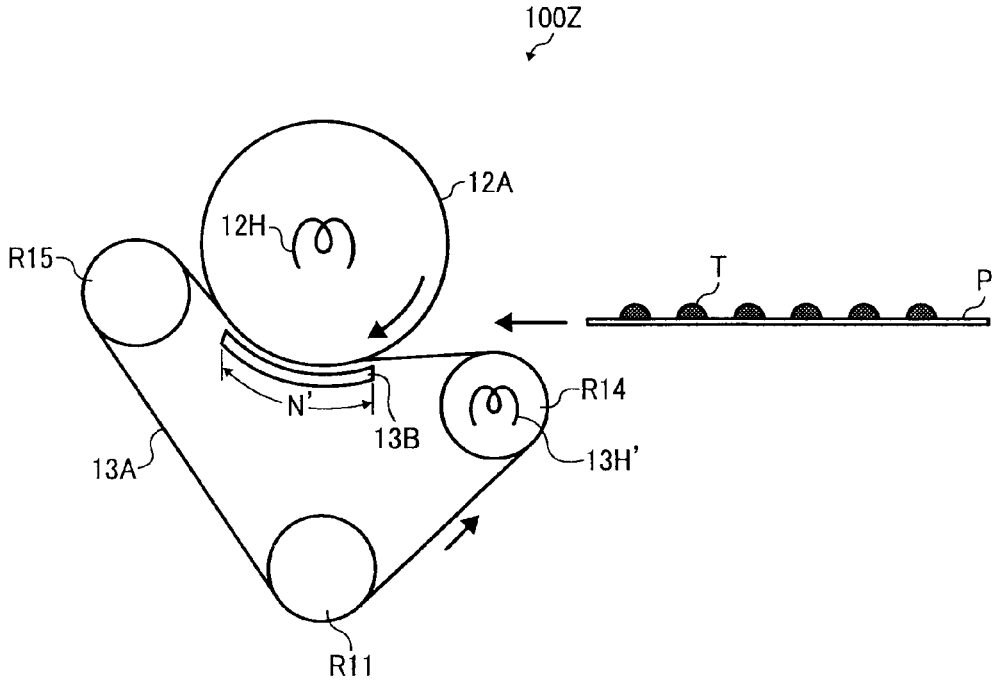
FIG. 10 is a sectional view of a fixing device according to yet another exemplary embodiment of the present invention.

Referring to FIG. 10, the following describes a fixing device 100Z according to yet another exemplary embodiment. FIG. 10 is a sectional view of the fixing device 100Z. The fixing device 100Z includes a fixing roller 12A, a heater 12H, rollers R11, R14, and R15, a pressing belt 13A, a backup member 13B, and a heater 13H'.

The fixing roller 12A, serving as a fixing member, is provided above the pressing belt 13A serving as a pressing member, and rotates clockwise in FIG. 10. The pressing belt 13A provided under the fixing roller 12A rotates counterclockwise in FIG. 10, and is looped over the rollers R11, R14, and R15. The backup member 13B, serving as a pressing pad, faces an inner circumferential surface of the pressing belt 13A to cause the pressing belt 13A to contact the fixing roller 12A and form a fixing nip portion N' between the fixing roller 12A and the pressing belt 13A. The heater 12H is provided inside the fixing roller 12A, and generates heat to heat the fixing roller 12A. The heater 13H' is provided inside the roller R14, and generates heat to heat the pressing belt 13A.

The oil applier 21 depicted in FIG. 3 applies oil to the fixing roller 12A provided above the pressing belt 13A. The oil applier 22 depicted in FIG. 3 applies oil to the pressing belt 13A provided under the fixing roller 12A.

Figure 11:
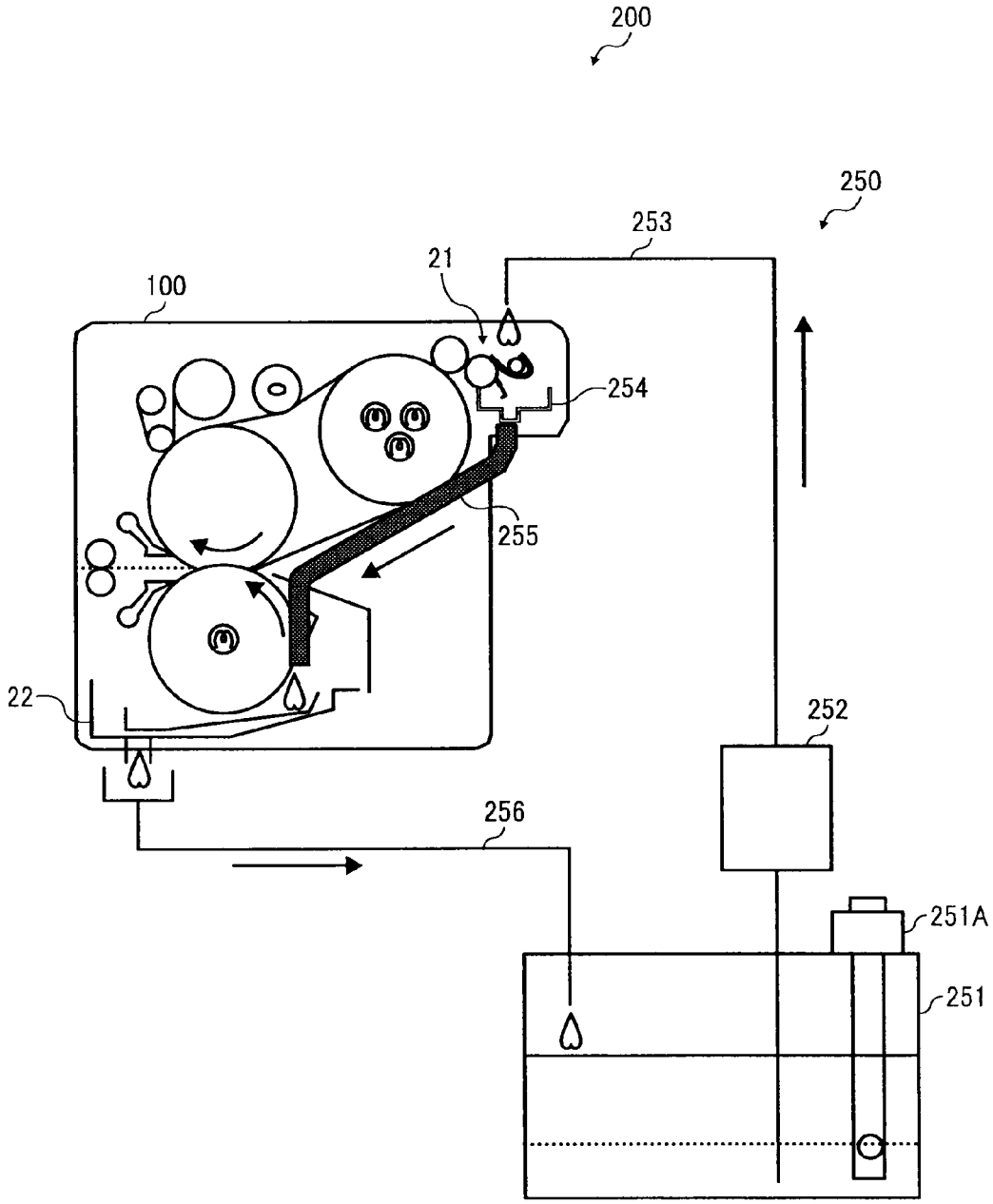
FIG. 11 is a schematic view of an oil circulation mechanism included in the image forming apparatus shown in FIG. 2.

Referring to FIG. 11, the following describes the oil circulation mechanism 250 included in the image forming apparatus 200 depicted in FIG. 2. FIG. 11 is a schematic view of the oil circulation mechanism 250. The oil circulation mechanism 250 further includes a conveyance path 253, an oil receiver 254, a tube 255, and a conveyance path 256. The oil tank 251 includes an oil sensor 251A.

The oil tank 251 contains oil to be used in the fixing device 100. The oil pump 252 uses a piezoelectric element. The conveyance path 253 connects the oil pump 252 to the oil applier 21 of the fixing device 100. The oil receiver 254 receives surplus oil sent from the oil applier 21. The tube 255 conveys the oil sent from the oil receiver 254 to the oil applier 22. The conveyance path 256 connects the oil applier 22 to the oil tank 251. The oil tank 251, the oil pump 252, and the conveyance paths 253 and 256 are disposed outside the fixing device 100. The oil receiver 254 and the tube 255 are disposed inside the fixing device 100. The oil sensor 251A detects an amount of oil remaining in the oil tank 251.

In the image forming apparatus 200, the oil circulation mechanism 250 circulates oil as described below so that the oil appliers 21 and 22 sequentially apply oil to the fixing belt 12 and the pressing roller 13 depicted in FIG. 3, respectively.

For example, when an image forming operation starts, the oil pump 252 pumps silicon oil from the oil tank 251, which stores a total volume of about 4 liters of silicon oil, and conveys the oil to the oil applier 21 through the conveyance path 253. In the oil applier 21 depicted in FIG. 5, the oil is put into the oil storage 21B through the oil inlet 21A at a supply speed of about 3 grams per minute.

The oil receiver 254 collects surplus oil from the oil applier 21. The surplus oil is conveyed to the oil applier 22 provided for the pressing roller 13 (depicted in FIG. 3) through the tube 255. A filter filters oil used in the oil applier 22 to remove impurities, and the filtered oil is collected into the oil tank 251 through the conveyance path 256.

In the image forming apparatus 200 depicted in FIG. 2, a sheet may be jammed in the fixing device 100. In this case, a user pulls the fixing device 100 out of the image forming apparatus 200 to remove a jammed sheet. Further, the user may pull the fixing device 100 out of the image forming apparatus 200 to perform maintenance. In this case, the user performs necessary processes on the fixing device 100 removed out of the image forming apparatus 200, and then inserts the fixing device 100 into an original position in the image forming apparatus 200. However, the oil applier 21 may become short of oil after a series of the above-described processes. The following describes reasons of the shortage of oil.

When the fixing device 100 is detached from (e.g., pulled out of) the image forming apparatus 200, the oil pump 252 of the oil circulation mechanism 250 stops, and thereby oil is not put into the oil applier 21 of the fixing device 100.

The fixing device 100 is pulled out as a unit. For example, the fixing device 100 slides on a rail provided in the image forming apparatus 200. When the fixing device 100 is completely pulled out and is disposed outside the image forming apparatus 200, the fixing device 100 is cantilevered and supported by the rail. Since the fixing device 100 has a weight of several tens of kilograms, a front end of the fixing device 100, which is farthest from the image forming apparatus 200, is lowered with respect to a rear end of the fixing device 100, which is opposite the front end and nearest the image forming apparatus 200. In other words, the fixing device 100 is tilted. Even when the fixing device 100 is pulled out in methods other than the method in which the fixing device 100 slides on the rail as described above, the fixing device 100 may be tilted.

Accordingly, the oil storage 21B depicted in FIG. 5 provided inside the fixing device 100 is tilted in the longitudinal direction of the oil storage 21B, and thereby oil stored in the oil storage 21B overflows the oil storage 21B. The oil receiver 254 receives the overflown oil.

After a predetermined process is performed, the fixing device 100 is reattached to the original position inside the image forming apparatus 200, and returns to an original horizontal state. Accordingly, the oil storage 21B returns to an original horizontal state. However, since a part of oil has overflown the oil storage 21B when the fixing device 100 was detached from the image forming apparatus 200, an oil level, which has been near the cut portion 21B1 (depicted in FIG. 5) of the oil storage 21B before the fixing device 100 was pulled out, lowers substantially from the cut portion 21B1 of the oil storage 21B after the fixing device 100 is reattached to the image forming apparatus 200.

Consequently, when an image forming operation starts after the fixing device 100 is reattached to the image forming apparatus 200, oil is not supplied from the oil storage 21B to the adjacent oil supply member (e.g., the supply felt 21D depicted in FIG. 5 and the supply roller 21E depicted in FIG. 8) or the oil application member (e.g., the application roller 23 depicted in FIGS. 5 and 8 and the application felt 23' depicted in FIG. 9) quickly. Namely, the oil applier 21 does not apply oil to the fixing belt 12. As a result, the fixing belt 12 and/or the pressing roller 13 depicted in FIG. 3 become short of oil, and thereby a sheet P is adhered to or wraps around the fixing belt 12 and/or the pressing roller 13, resulting in sheet jam and formation of a faulty image, such as a solid image with streaks. The following describes improved driving control to address this problem, which is performed before an image formation when the fixing device 100 is reattached to the image forming apparatus 200.

For example, when the fixing device 100 depicted in FIG. 2 is reattached to the image forming apparatus 200 depicted in FIG. 2 after the fixing device 100 is detached from the image forming apparatus 200, an oil input device (e.g., the oil tank 251, the oil pump 252, and the conveyance path 253 depicted in FIG. 11) puts oil into the oil storage 21B of the fixing device 100, and then the image forming apparatus 200 performs an image forming operation.

Figure 12:
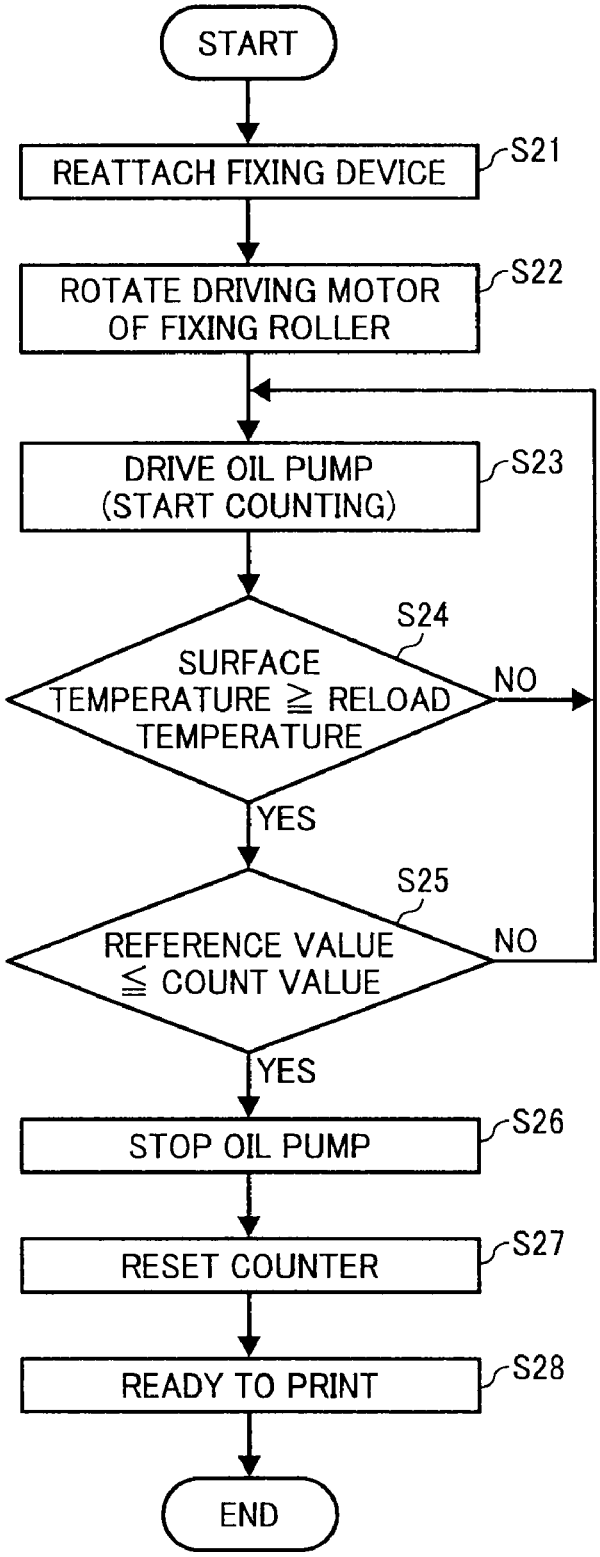
FIG. 12 is a flowchart illustrating control for supplying oil in the image forming apparatus shown in FIG. 2.
Figure 13:
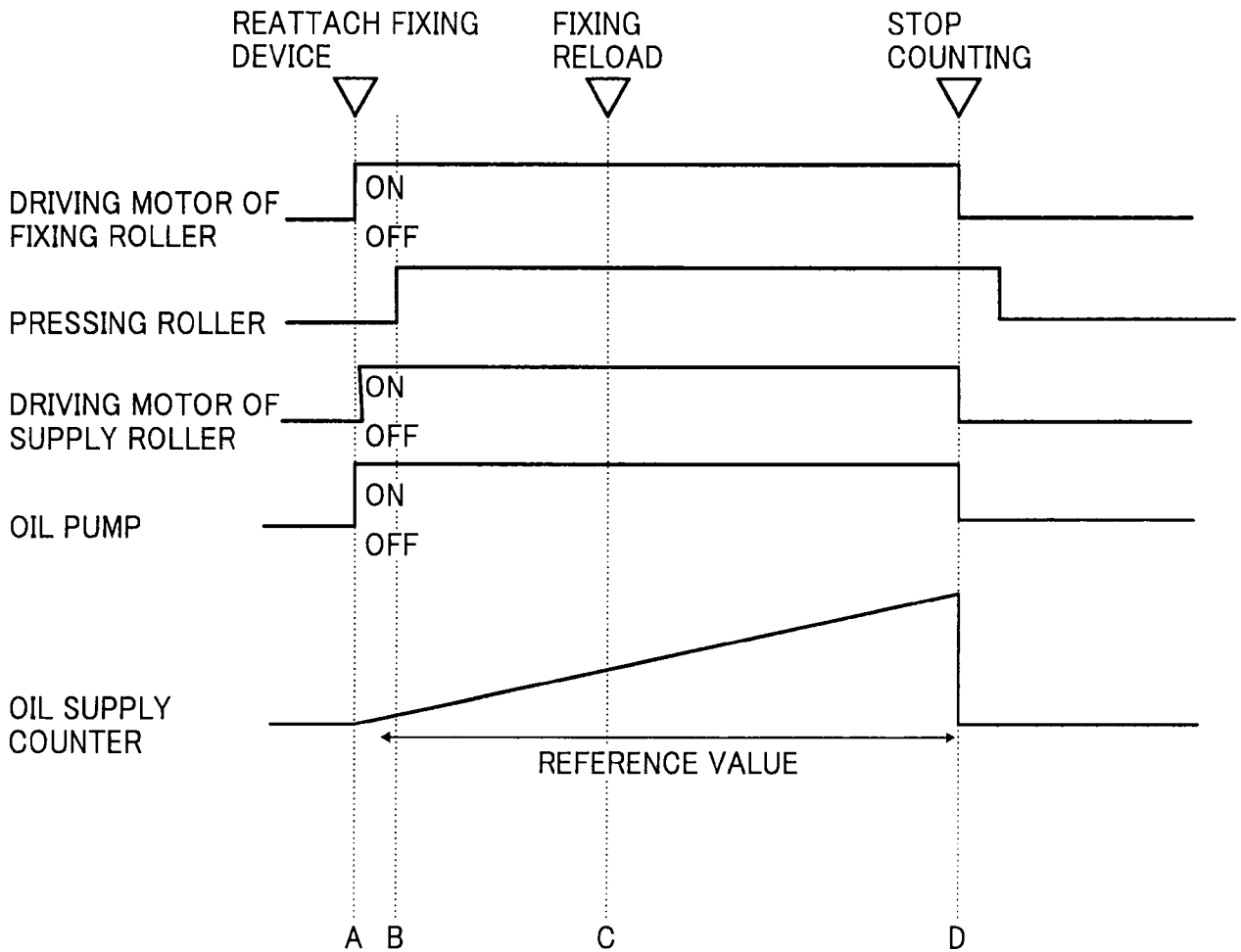
FIG. 13 is a timing chart illustrating driving control for the fixing device shown in FIG. 3 and the oil circulation mechanism shown in FIG. 11.

FIG. 12 is a flowchart illustrating control for supplying oil in the image forming apparatus 200. FIG. 13 is a timing chart illustrating driving control for the fixing device 100 and the oil circulation mechanism 250 depicted in FIG. 11. Referring to FIGS. 11 to 13, the following describes processes of control for supplying oil.

In step S21, the fixing device 100 depicted in FIG. 2 is reattached to the image forming apparatus 200 depicted in FIG. 2 after the fixing device 100 is detached from the image forming apparatus 200. At this moment, the pressing roller 13 depicted in FIG. 3 separates from the fixing belt 12 depicted in FIG. 3, and thereby does not apply pressure to the fixing belt 12.

In step S22, the controller 260 depicted in FIG. 2 starts rotating a driving motor for driving the fixing roller 11 depicted in FIG. 3 to rotate the fixing belt 12, as illustrated in FIG. 13. Simultaneously, the controller 260 starts rotating a driving motor for driving the supply roller 21E depicted in FIG. 5, as illustrated in FIG. 13, to rotate the supply roller 21E and the application roller 23 depicted in FIG. 5. Further, the controller 260 turns on the heater 14H disposed inside the heating roller 14 depicted in FIG. 3 to generate heat so as to heat the fixing belt 12.

In step S23, the controller 260 drives the oil pump 252 (depicted in FIG. 11) as illustrated in FIG. 13 so that oil is supplied from the oil tank 251 depicted in FIG. 11 to the oil storage 21B depicted in FIG. 5 of the fixing device 100 through the conveyance path 253 depicted in FIG. 11. Simultaneously, an oil supply counter starts counting a count value T as illustrated in FIG. 13. The count value T indicates an oil supply time.

Steps S22 and S23 start simultaneously at point A shown in FIG. 13. Thereafter, when rotation of the fixing belt 12 and the supply roller 21E is stabilized, the pressing roller 13 contacts and presses against the fixing belt 12 to form the fixing nip portion N depicted in FIG. 3 at point B shown in FIG. 13.

In step S24, a thermometer measures a surface temperature (e.g., a fixing temperature) of the fixing belt 12, and the controller 260 judges whether or not the surface temperature of the fixing belt 12 reaches a predetermined temperature (e.g., a reload temperature corresponding to a warm-up temperature) or higher. When the surface temperature of the fixing belt 12 is lower than the predetermined temperature (e.g., when NO is selected in step S24), steps S23 and S24 continue. Namely, oil is supplied to the oil storage 21B at least until the surface temperature of the fixing belt 12, serving as a fixing member, reaches the predetermined temperature.

In step S25, when the surface temperature of the fixing belt 12 reaches the predetermined temperature or higher (e.g., when YES is selected in step S24) at point C shown in FIG. 13, the controller 260 judges whether or not the count value T counted by the oil supply counter reaches a reference value or greater, to secure a certain amount of oil supplied to the oil storage 21B. The reference value indicates the amount of oil supplied to the oil storage 21B and is adjustable. For example, the reference value may be adjusted according to type of a sheet P (e.g., plain paper and coated paper) previously used. When the previously used sheet P is coated paper, a greater value may be used as the reference value compared to a value used for plain paper. When the count value T counted by the oil supply counter is lower than the reference value (e.g., when NO is selected in step S25), steps S23 to S25 continue. Namely, oil is supplied to the oil storage 21B until the amount of oil supplied to the oil storage 21B reaches a predetermined amount.

In step S26, when the count value T counted by the oil supply counter reaches the reference value or greater (e.g., when YES is selected in step S25) at point D shown in FIG. 13, the controller 260 stops driving the oil pump 252. Accordingly, oil supply to the oil storage 21B temporarily stops until an image forming operation starts.

In step S27, the controller 260 resets the count value T counted by the oil supply counter.

In step S28, the image forming apparatus 200 becomes ready to start an image forming operation (e.g., to print an image). Namely, an oil level in the oil storage 21B reaches the cut portion 21B1 depicted in FIG. 5. Therefore, even immediately after an image forming operation starts, a sufficient amount of oil can be applied to the fixing belt 12 or the pressing roller 13. Thereafter, the image forming apparatus 200 is on standby for an image forming job.

According to the above-described exemplary embodiments, the oil circulation mechanism 250 circulates oil to the oil applier 21 provided near the fixing belt 12 serving as a fixing member and the oil applier 22 provided near the pressing roller 13 serving as a pressing member. Alternatively, the above-described exemplary embodiments may be applied to an oil circulation mechanism for circulating oil only to the oil applier 21 provided near the fixing belt 12, for example.

According to the above-described exemplary embodiments, even when a fixing device (e.g., the fixing device 100 depicted in FIG. 5, the fixing device 100X depicted in FIG. 8, the fixing device 100Y depicted in FIG. 9, or the fixing device 100Z depicted in FIG. 10) is temporarily detached from an image forming apparatus (e.g., the image forming apparatus 200 depicted in FIG. 2) to remove a jammed sheet, for example, and then the fixing device is reattached to the image forming apparatus, oil overflows and falls down freely from an upper portion (e.g., the cut portion 21B1 depicted in FIGS. 5, 8, and 9) of an oil storage member (e.g., the oil storage 21B depicted in FIGS. 5, 8, and 9) to an adjacent oil supply member (e.g., the supply felt 21D depicted in FIG. 5, the supply roller 21E depicted in FIG. 8, or the application felt 23' depicted in FIG. 9) disposed under the oil storage member, and then to an oil application member (e.g., the application roller 23 depicted in FIGS. 5 and 8 or the application felt 23' depicted in FIG. 9), when an image forming operation starts. Thus, a sufficient amount of oil can be applied to a fixing member (e.g., the fixing belt 12 depicted in FIGS. 5, 8, and 9 or the fixing roller 12A depicted in FIG. 10) and/or a pressing member (e.g., the pressing roller 13 depicted in FIG. 3 or the pressing belt 13A depicted in FIG. 10) stably, maintaining proper property for separating a recording medium from the fixing member and/or the pressing member.

According to the above-described exemplary embodiments, the image forming apparatus including the fixing device can provide improved fixing and separation functions, and therefore can handle various types of paper, such as thin paper and thick paper, and various types of image formation, such as a narrower top margin on a sheet.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an oil input device to contain oil; and a fixing device to receive oil sent from the oil input device, the fixing device including a rotatable fixing member;

a pressing member to contact the fixing member; and an oil applier, the oil applier including an oil application member to apply oil to one of the fixing member and the pressing member across a predetermined width of the fixing member and the pressing member; and an oil supply mechanism to supply oil to the oil application member, the oil supply mechanism including an oil storage member to store oil;

an oil inlet to put oil sent from the oil input device into the oil storage member; and an oil supply member provided adjacent to the oil storage member to supply oil sent from the oil storage member to the oil application member, the oil storage member provided above and adjacent to one of the oil supply member and the oil application member, wherein, when the fixing device is reattached to the image forming apparatus after the fixing device is detached from the image forming apparatus, oil sent from the oil input device overflows the oil storage member, and is supplied to one of the oil supply member and the oil application member provided adjacent to the oil storage member before an image forming operation starts.

2. The image forming apparatus according to claim 1, wherein the oil storage member comprises an upwardly concave gutter, and a long side of the oil storage member is disposed parallel to the oil application member.

3. The image forming apparatus according to claim 1, wherein the oil input device supplies oil to the oil storage member of the fixing device until an amount of oil supplied from the oil input device reaches a predetermined amount, when the fixing device is reattached to the image forming apparatus after the fixing device is detached from the image forming apparatus.

4. An image forming apparatus, comprising:

an oil input device to contain oil; and a fixing device to receive oil sent from the oil input device, the fixing device including a rotatable fixing member;

a pressing member to contact the fixing member; and an oil applier, the oil applier including oiling means for applying oil to one of the fixing member and the pressing member across a predetermined width of the fixing member and the pressing member; and an oil supply mechanism to supply oil to the oiling means, the oil supply mechanism including an oil storage member provided above and adjacent to the oiling means to store oil; and an oil inlet to put oil sent from the oil input device into the oil storage member, wherein, when the fixing device is reattached to the image forming apparatus after the fixing device is detached from the image forming apparatus, oil sent from the oil input device overflows the oil storage member, and is supplied to the oiling means provided adjacent to the oil storage member before an image forming operation starts.

5. The image forming apparatus according to claim 4, wherein the oil storage member comprises an upwardly concave gutter, and a long side of the oil storage member is disposed parallel to the oiling means.

6. The image forming apparatus according to claim 4, wherein the oil input device supplies oil to the oil storage member of the fixing device at least until the fixing member has a predetermined temperature, when the fixing device is reattached to the image forming apparatus after the fixing device is detached from the image forming apparatus.

7. The image forming apparatus according to claim 4, wherein the oil input device supplies oil to the oil storage member of the fixing device until an amount of oil supplied from the oil input device reaches a predetermined amount, when the fixing device is reattached to the image forming apparatus after the fixing device is detached from the image forming apparatus.

8. An image forming apparatus, comprising:

an oil input device to contain oil; and a fixing device to receive oil sent from the oil input device, the fixing device including a rotatable fixing member;

a pressing member to contact the fixing member; and an oil applier, the oil applier including an oil application member to apply oil to one of the fixing member and the pressing member across a predetermined width of the fixing member and the pressing member; and an oil supply mechanism to supply oil to the oil application member, the oil supply mechanism including an oil storage member to store oil;

an oil inlet to put oil sent from the oil input device into the oil storage member; and an oil supply member provided adjacent to the oil storage member to supply oil sent from the oil storage member to the oil application member, the oil storage member provided above and adjacent to one of the oil supply member and the oil application member, wherein, when the fixing device is reattached to the image forming apparatus after the fixing device is detached from the image forming apparatus, oil sent from the oil input device overflows the oil storage member, and is supplied to one of the oil supply member and the oil application member provided adjacent to the oil storage member before an image forming operation starts, wherein the oil input device supplies oil to the oil storage member of the fixing device at least until the fixing member has a predetermined temperature, when the fixing device is reattached to the image forming apparatus after the fixing device is detached from the image forming apparatus.

9. The image forming apparatus of claim 1, wherein the oil storage member includes a cut portion at which the oil overflows when the fixing device is reattached to the image forming apparatus.

* * * * *